US009885331B2

(12) United States Patent
Horst et al.

(10) Patent No.: US 9,885,331 B2
(45) Date of Patent: Feb. 6, 2018

(54) DECOUPLING ELEMENT FOR A FUEL INJECTION DEVICE

(71) Applicant: Robert Bosch GmbH, Stuttgart (DE)

(72) Inventors: Hans-Georg Horst, Leonberg (DE); Michael Fischer, Niefern-Oeschelbronn (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/261,113

(22) Filed: Sep. 9, 2016

(65) Prior Publication Data

US 2017/0074225 A1 Mar. 16, 2017

(30) Foreign Application Priority Data

Sep. 14, 2015 (DE) ..... 10 2015 217 500

(51) Int. Cl.
*F02M 61/14* (2006.01)

(52) U.S. Cl.
CPC ..... *F02M 61/14* (2013.01); *F02M 2200/50* (2013.01); *F02M 2200/857* (2013.01); *F02M 2200/858* (2013.01)

(58) Field of Classification Search
CPC ..... F02M 61/14; F02M 2200/50; F02M 2200/857; F02M 2200/858
USPC ..... 123/470
See application file for complete search history.

(56) References Cited

U.S. PATENT DOCUMENTS

| | | | | |
|---|---|---|---|---|
| 3,038,456 | A * | 6/1962 | Dreisin | F02M 61/14 123/470 |
| 3,992,974 | A * | 11/1976 | Miki | F16B 31/028 29/445 |
| 6,009,856 | A | 1/2000 | Smith, III et al. | |
| 2007/0175451 | A1* | 8/2007 | Beardmore | F02M 61/14 123/470 |

FOREIGN PATENT DOCUMENTS

| | | | | |
|---|---|---|---|---|
| DE | 10027662 | A1 | 12/2001 | |
| DE | 10038763 | A1 | 2/2002 | |
| DE | 10108466 | A1 | 9/2002 | |
| EP | 1223337 | A1 | 7/2002 | |
| WO | WO 2008107225 | A1 * | 9/2008 | F02M 61/14 |

* cited by examiner

*Primary Examiner* — Mahmoud Gimie
(74) *Attorney, Agent, or Firm* — Norton Rose Fulbright US LLP; Gerard Messina

(57) ABSTRACT

The decoupling element for a fuel injection device according to the invention is characterized in particular in that a low noise design is implemented. The fuel injection device includes at least one fuel injector and a receiving borehole in a cylinder head for the fuel injector, and the decoupling element between a valve housing of the fuel injector and a wall of the receiving borehole. The decoupling element is a decoupling system made up of a contoured spring seat on a shoulder of the receiving borehole and a spring washer resting on the shoulder. The fuel injection device is suited in particular for direct injection of fuel into a combustion chamber of a mixture-compressing spark-ignition internal combustion engines.

8 Claims, 4 Drawing Sheets

DECOUPLING ELEMENT FOR A FUEL INJECTION DEVICE

CROSS REFERENCE

The present application claims the benefit under 35 U.S.C. §119 of German Patent Application No. DE 102015217500.6 filed on Sep. 14, 2015, which is expressly incorporated herein by reference in its entirety.

FIELD

The present invention is directed to a decoupling element for a fuel injection device.

BACKGROUND INFORMATION

In FIG. 1, a conventional fuel injection device from the related art is shown as an example, in which a flat intermediate element is provided on a fuel injector installed in a receiving borehole of a cylinder head of an internal combustion engine. Such intermediate elements are placed in a conventional way as support elements in the form of a washer on a shoulder of the receiving borehole of the cylinder head. With the aid of such intermediate elements, manufacturing and assembly tolerances are compensated and a mounting free of lateral forces is ensured even at a slight inclination of the fuel injector. The fuel injection device is suited in particular for use in fuel injection systems of mixture-compressing spark-ignition internal combustion engines.

Another type of a simple intermediate element for a fuel injection device is described in German Patent Application No. DE 101 08 466 A1. The intermediate element is a washer having a circular cross section which is situated in an area, in which both the fuel injector and the wall of the receiving borehole are truncated in the cylinder head, and is used as a compensating element for mounting and supporting the fuel injector.

More complex, and significantly more expensive to manufacture intermediate elements for fuel injection devices are described in German Patent Application Nos. DE 100 27 662 A1 and DE 100 38 763 A1, and European Patent Application No. EP 1 223 337 A1, among others. These intermediate elements are characterized in that they all have a multipart or multilayered design, and are to take on sealing and damping functions in part.

The intermediate element described in German Patent Application No. DE 100 27 662 A1 includes a base- and support body, in which a sealing element is inserted which is penetrated by a nozzle body of the fuel injector. In German Patent Application No. DE 100 38 763 A1, a multilayer compensating element is known, which is composed of two rigid rings and an elastic intermediate ring situated sandwiched therebetween. This compensating element enables both a tilting of the fuel injector toward the axis of the receiving borehole across a relatively large angle range and a radial displacement of the fuel injector from the center axis of the receiving borehole.

A likewise multilayered intermediate element is also described in European Patent Application No. EP 1 223 337 A1, this intermediate element being composed of multiple washers which are made of a muffling material. The muffling material, made from metal, rubber, or PTFE, is selected and designed in such a way that noise muffling of the vibrations and noises generated by operating the fuel injector is enabled. The intermediate element must, however, include four to six layers for this purpose to achieve a desired muffling effect.

For reducing noise emissions, U.S. Pat. No. 6,009,856 A moreover proposes to surround the fuel injector with a sleeve and to fill the resulting intermediate space with an elastic, noise-muffling material. This type of noise muffling is, however, very complex, installation unfriendly, and expensive.

SUMMARY

An example decoupling element according to the present invention for a fuel injection device may have the advantage that an improved noise muffling is achieved in a particularly simple design. According to the present invention, the decoupling element has an approximately bilinear or non-linear, progressive spring characteristic, due to which multiple positive and advantageous aspects result with the installation of the decoupling element in a fuel injection device including injectors for direct fuel injection. The low stiffness of the decoupling element at an idle point enables an effective decoupling of the fuel injector from the cylinder head and thus considerably reduces the noise emitted from the cylinder head during the noise-critical idle operation. The great stiffness at nominal system pressure provides, on the one hand, for an overall low movement of the fuel injector during vehicle operation and thus ensures the durability of the sealing rings, which are used for combustion chamber sealing and as sealing against the fuel rail, and, on the other hand, ensures a stable injection point of the fuel spray in the combustion chamber which is decisive for the stability of some combustion processes.

The decoupling element is characterized by a very low overall height, whereby it is also usable in small installation spaces similar to a standard disk spring. The decoupling element additionally has a great endurance strength even at high temperatures. The only component required for the decoupling element is a spring washer, which is very simple in terms of manufacturing, inexpensive, and is reliably manufacturable and reproducible in great numbers. The machining of the receiving borehole in the area of the contoured shoulder to be used as the spring seat is likewise possible and comparatively easy with known tools. The complete suspension of the system made up of the fuel injector and the decoupling element may additionally be easily and quickly assembled or disassembled.

Advantageous refinements of and improvements on the decoupling element are described herein.

It is particularly advantageous to carry out the contouring of the spring seat to form an air gap between the spring seat and the spring washer. The spring seat may thereby advantageously have an upper shoulder on its end face, or the upper side of the shoulder of the receiving borehole facing the spring washer is designed with a tapered or conical end face or with a pulvinate end face. The design of the decoupling element is carried out in such a way that the height of the air gap may vary slightly without impairing the decoupling effect, or that plastic deformations that are too great occur at the spring washer. This design strategy additionally results in an advantageous way to an improved robustness of the construction with respect to contamination phenomena over the service life.

BRIEF DESCRIPTION OF THE DRAWINGS

Exemplary embodiments of the present invention are represented in simplified form in the figures and are described in greater detail below.

DETAILED DESCRIPTION OF EXAMPLE EMBODIMENTS

Figure 1:
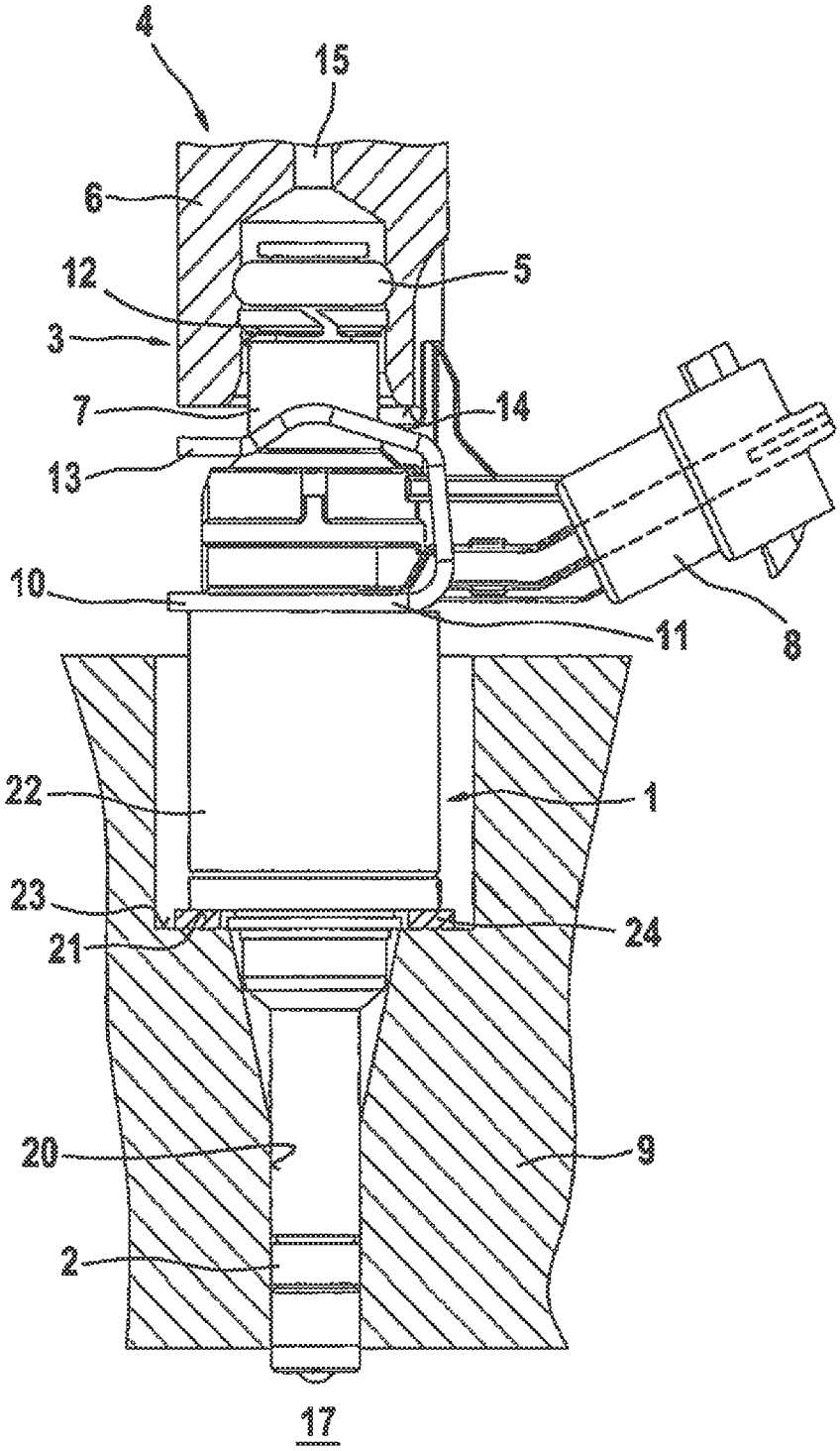
FIG. 1 shows a partially depicted fuel injection device in a known embodiment including a disk-shaped intermediate element.

To assist in understanding the present invention, a conventional specific embodiment of a fuel injection device is subsequently described in greater detail with reference to FIG. 1. In FIG. 1, a valve in the form of an injector 1 for fuel injection systems of mixture-compressing spark-ignition internal combustion engines is depicted in a side view as an exemplary embodiment. Fuel injector 1 is part of the fuel injection device. Fuel injector 1, which is designed in the form of a direct injecting injector for direct injection of fuel into a combustion chamber 17 of the internal combustion engine, is installed with a downstream end in a receiving borehole 20 of a cylinder head 9. A sealing ring 2, in particular made of Teflon™, provides an optimal sealing of fuel injector 1 against the wall of receiving borehole 20 of cylinder head 9.

A flat intermediate element 24, which is designed as a support element in the form of a washer, is inserted between a shoulder 21 of a valve housing 22 and a shoulder 23 of receiving borehole 20 which runs, for example, at a right angle to the longitudinal extension of receiving borehole 20. With the aid of such an intermediate element 24, manufacturing and assembly tolerances are compensated and a mounting free of lateral forces is ensured even at a slightly inclined position of fuel injector 1.

Fuel injector 1 has a plug connection to a fuel distribution line (fuel rail) 4 on its inflow side end 3, the plug connection is sealed by a sealing ring 5 between a connection piece 6 of fuel distribution line 4, which is shown in cross-section, and an intake connecting piece 7 of fuel injector 1. Fuel injector 1 is inserted into a receiving opening 12 of connection piece 6 of fuel distribution line 4. Connection piece 6 thereby extends, e.g., as one piece, from actual fuel distribution line 4 and has a smaller diameter flow opening 15 upstream from receiving opening 12 and via which the inflow of fuel injector 1 takes place. Fuel injector 1 has an electrical connector plug 8 for the electrical contact for actuating fuel injector 1.

In order to space fuel injector 1 and fuel distribution line 4 apart from one another, largely free of radial forces, and to hold fuel injector 1 securely down in receiving borehole 20 of cylinder head 9, a holding-down clamp 10 is provided between fuel injector 1 and connection piece 6. Holding-down clamp 10 is designed as a U-shaped component, e.g., as a stamped and bent part. Holding-down clamp 10 has a partially ring-shaped base element 11, from which a bent retaining clip 13 extends and contacts a downstream end surface 14 of connection piece 6 at fuel distribution line 4 in the installed state.

An object of the present invention is to achieve, in a simple way, an improved noise muffling compared to the known intermediate element approaches, primarily during the noise-critical idle operation, using a targeted design and geometry of intermediate element 24. The decisive noise source of fuel injector 1 during direct high-pressure injection includes forces (structure-borne noise) introduced into cylinder head 9 during the valve operation, which result in a structural stimulation of cylinder head 9, from whence this is emitted as airborne noise. To achieve noise improvement, a minimization of the forces introduced into cylinder head 9 is therefore sought. In addition to the reduction of forces caused by the injection, this may be achieved by influencing the transmission behavior between fuel injector 1 and cylinder head 9.

Figure 2:
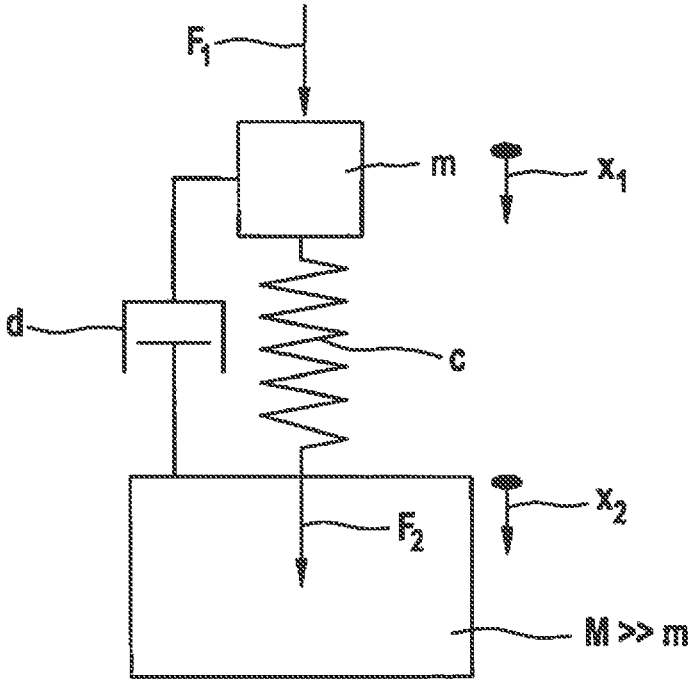
FIG. 2 shows a mechanically equivalent circuit diagram of the support of the fuel injector in the cylinder head during direct fuel injection which depicts a conventional spring-mass-damper system.
Figure 3:
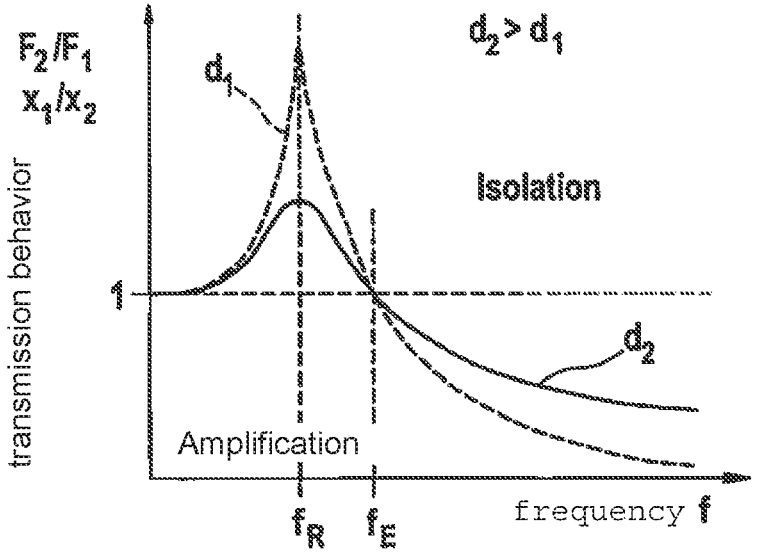
FIG. 3 shows the transmission behavior of a spring-mass-damper system shown in FIG. 2, with amplification at low frequencies in the range of the resonance frequency $f_R$ and an isolation range above the decoupling frequency $f_E$.

Mechanically, the mounting of fuel injector 1 on passive intermediate element 24 in receiving borehole 20 of cylinder head 9 may be designed as a conventional spring-mass-damper system, as this is depicted in FIG. 2. Mass M of cylinder head 9 may thereby be assumed in a first approximation to be infinitely large in comparison to the mass m of fuel injector 1. The transmission behavior of such a system is characterized by an amplification at low frequencies in the range of resonance frequency $f_R$ and an isolation range above decoupling frequency $f_E$ (see FIG. 3).

An objective of the present invention is the design of an intermediate element 24 with the primary use of elastic isolation (decoupling) for noise reduction, in particular during idle operation of the vehicle. The present invention thereby includes, on the one hand, the definition and design of a suitable spring characteristic under consideration of the typical demands and boundary conditions during direct fuel injection at variable operating pressure and, on the other hand, the design of an intermediate element 24 which is capable of mapping the characteristics of the spring characteristic thus defined and may be adapted to the specific boundary conditions of the injection system by selecting simple geometric parameters.

The decoupling of fuel injector 1 from cylinder head 9 with the aid of a low spring stiffness c of the decoupling system according to the present invention, which is formed from a contoured spring seat 25 and a spring washer 26, is made more difficult by a limitation of the permissible maximum movement of fuel injector 1 during engine operation, in addition to the small installation space. In the vehicle, the following quasi-static load states occur:

1. static hold-down force $F_{NH}$ due to a holding-down clamp 10 applied after assembly,
2. force $F_L$ present during idle operation pressure, and
3. force $F_{sys}$ present at nominal system pressure.

Conventional support elements used as intermediate elements 24 have a linear spring characteristic in the aforementioned force area. Consequently, the stiffness of intermediate element 24 in the intended decoupling point during idle operation must be oriented towards the above defined, maximum permissible movement of fuel injector 1 and is too great for an effective decoupling. Since the nominal operating pressures will presumably continue to increase in the future, this problem will continue to intensify.

To solve this conflict, an approximately bilinear spring characteristic is provided for decoupling system 25, 26 according to the present invention. The characteristics of this spring characteristic allow a noise decoupling with the aid of a low spring stiffness ($S_{NVH}$) during idle operation and allow the maintenance of the maximum movement of fuel injector 1 between idle operation and system pressure due to the quickly increasing stiffness.

To be able to implement the approximately bilinear spring characteristic during typical boundary conditions of the direct fuel injection (small installation space, large forces, small total movement of fuel injector 1) in a simple and cost-efficient way, the decoupling system according to the present invention is constructed from a contoured spring seat 25 and a spring washer 26, a desired spring characteristic being generated in particular by spring washer 26 and its particular geometric design.

Figure 4:
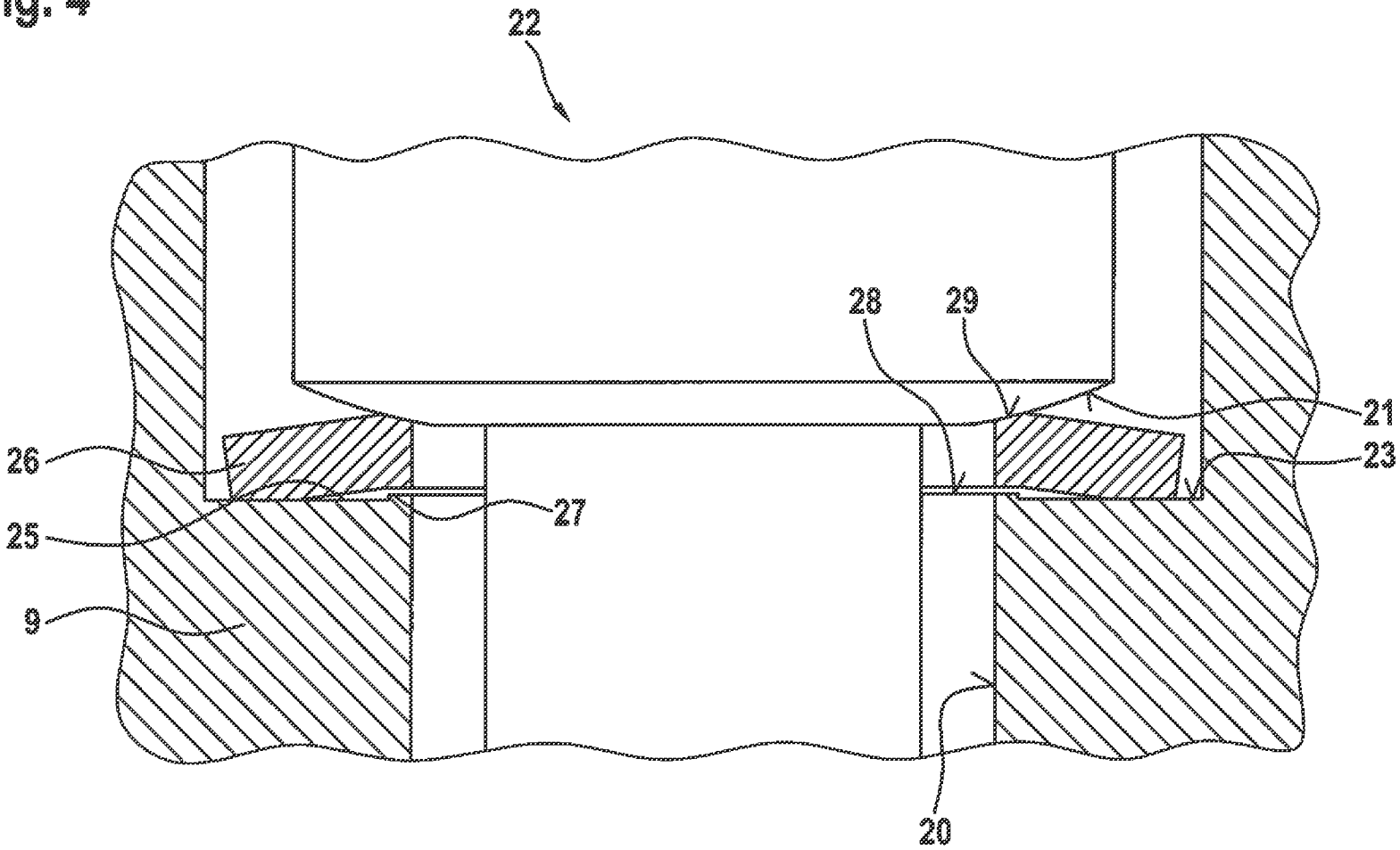
FIG. 4 shows a cross section through a decoupling element according to the present invention in an installed state at a fuel injector in the area of the disk-shaped intermediate element shown in FIG. 1.

FIG. 4 shows a cross section through a decoupling system according to the present invention in an installed state at a fuel injector 1 in the area of disk-shaped intermediate element 24 shown in FIG. 1, intermediate element 24 being replaced by a unit according to the present invention made up of spring seat 25 and spring washer 26.

The elasticity of the decoupling system results from the deflection of spring washer 26 in the case of an axial load. At increasing system pressures during direct gasoline injection, the static axial compressive load affecting fuel injector 1 also increases (in the maximum case up to 4 kN). Using a classic, standard disk spring, there is no design in the case of the existing installation space which sufficiently satisfies the requirements of stiffness and also strength. At high system pressures, engine loads, and/or vehicle speeds, the engine, driving, or rolling noises drown out the noises originating in the injection system. From the point of view of acoustics, spring-loaded decoupling is therefore only necessary up to typical idle running system pressures. In the case according to the present invention, the design of spring washer 26 is carried out, e.g. up to an axial load of approximately 2 kN. The mechanical stresses generated up to this load point in spring washer 26 still lie below the load limit. At higher loads, the bottom side of spring washer 26 comes in contact with an upper stop 27 of an end face 28 of spring seat 25. Spring seat 25 is formed directly in cylinder head 9 by shoulder 23 of receiving borehole 20 while eliminating any additional components. Stop 27 is implemented as an annular elevation on shoulder 23 of receiving borehole 20 slightly projecting with respect to otherwise level end face 28. The stiffness of the combination of spring washer 26 with contoured spring seat 25 as a decoupling system is significantly higher than that of spring washer 26 alone. At further increasing load, spring washer 26 deforms only slightly and the stress also increases only marginally. A strength problem is circumvented in this way.

The deflection point of the already-mentioned, approximately bilinear spring characteristic of this decoupling system is determined by the air gap between upper stop 27 on spring seat 25 and the bottom side of spring washer 26. Spring washer 26 is designed in such a way that a preferably large difference occurs between force F1, up to which decoupling is necessary, and force F2, at which spring washer 26 and spring seat 25 come in contact in the area of stop 27. F2 may not, in turn, be greater than force Fmax, at which the maximum permissible stresses are reached in spring washer 26. F1<<F2<=Fmax therefore applies.

Due to this design, the height of the air gap may vary slightly without impairing the decoupling effect or allowing plastic deformations that are too great to occur at spring washer 26. The tolerance demand on the air gap during manufacturing of the components of the decoupling system thus lies in the usual range, and cost intensive special machining processes are not necessary during manufacturing. This design strategy additionally results in an advantageous way to achieve an improved robustness of the structure with respect to contamination phenomena over the service life.

In one first embodiment, spring washer 26 has a pulvinate section 29 on its upper side in the area of the radially inner end. As is apparent from FIGS. 5 and 6, section 29 may also be largely conical. A pivotable or tiltable connection for the tolerance compensation is created together with the conical, or likewise pulvinate valve housing surface 21, shown in FIG. 4. In the case of an offset between fuel injector 1 and receiving borehole 20 within the scope of tolerated manufacturing variations, a slight inclination of fuel injector 1 may occur. Due to the pivotable connection between fuel injector 1 and spring washer 26, lateral forces are largely avoided at an inclination of fuel injector 1.

Figure 5:
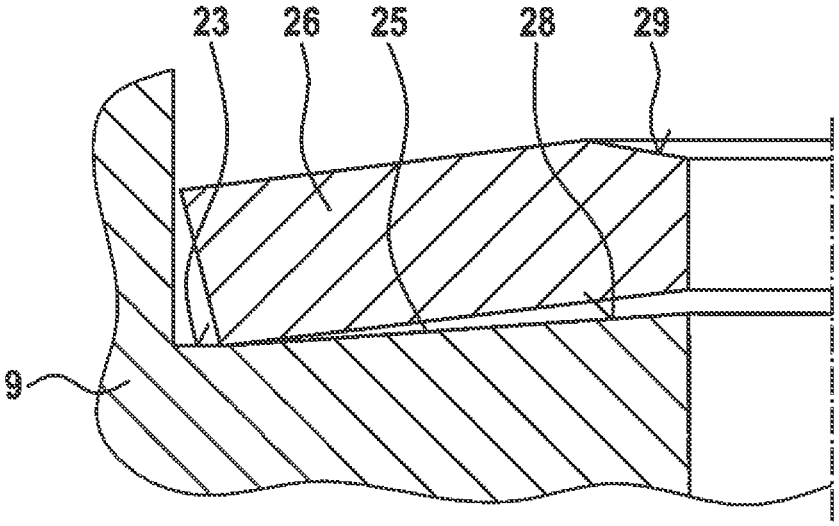
FIGS. 5 and 6 show two alternative specific embodiments of the decoupling element in a detailed view.
Figure 6:
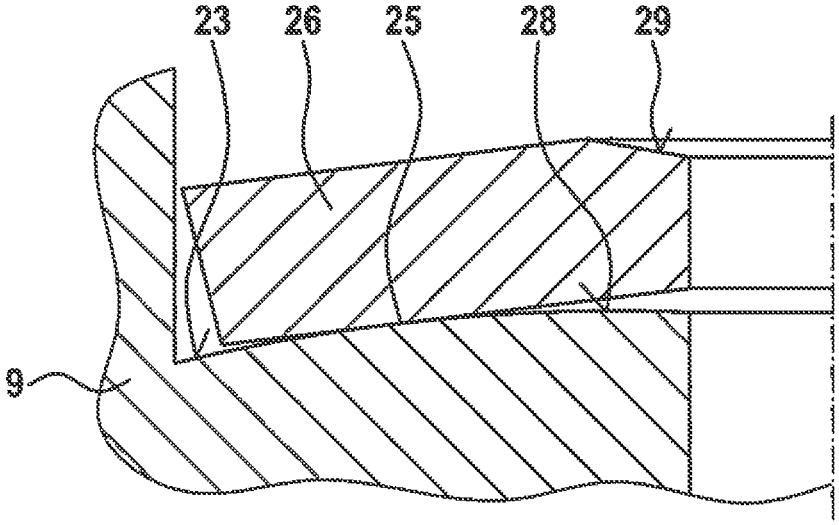

Two alternative specific embodiments of the decoupling element are presented in a detailed view in FIGS. 5 and 6. It is thereby apparent that spring seat 25 may also have other geometric moldings or recesses at the contoured upper end face 28 instead of stop 27. Thus, in the exemplary embodiment according to FIG. 5, the stepped end face 28 of shoulder 23 is replaced by a tapered or conical end face 28. The advantage of this specific embodiment lies in its very easy manufacturability. In addition, a better support arises in the case of blockage, since no excessive stresses are caused by edges.

As regards the embodiment according to FIG. 6, a pulvinate end face 28 is provided. Due to the convex design of end face 28 of spring seat 25, a continuous increase of the stiffness occurs due to the gradual reduction of the radius of the contact line during deflection of spring washer 26. The largely bilinear characteristic curve of the decoupling element shown in FIG. 4 is replaced in this case by a deflection-free, non-linear, progressively increasing spring characteristic, which may be particularly advantageous in some applications.

What is claimed is:

1. A decoupling element for a fuel injection device for a fuel injection system of an internal combustion engine for direct injection of fuel into a combustion chamber, the fuel injection device having at least one fuel injector and a receiving borehole for the fuel injector, and the decoupling element being introduced between a valve housing of the fuel injector and a wall of the receiving borehole, the decoupling element comprising:

a decoupling system made of a contoured spring seat on a shoulder of the receiving borehole and a spring washer resting on the shoulder, wherein the spring seat has, on its end face, an upper stop which represents a projecting annular elevation with respect to an otherwise level end face, wherein the upper stop is situated toward the valve housing with respect to the otherwise level end face.

2. The decoupling element as recited in claim 1, wherein the contouring of the spring seat is provided on the end face of the shoulder facing the spring washer to form an air gap between spring seat and spring washer.

3. The decoupling element as recited in claim 2, wherein the spring seat has a tapered or conical end face on the upper side facing the spring washer.

4. The decoupling element as recited in claim 2, wherein the spring seat has a pulvinate end face on an upper side facing the spring washer.

5. The decoupling element as recited in claim 1, wherein the spring washer has a pulvinate or conical section on its upper side in the area of its radially inner end, with which the spring washer establishes a pivotable or tiltable connection to the fuel injector for tolerance compensation.

6. The decoupling element as recited in claim 1, wherein the receiving borehole for the fuel injector is formed in a cylinder head.

7. A decoupling element for a fuel injection device for a fuel injection system of an internal combustion engine for direct injection of fuel into a combustion chamber, the fuel injection device having at least one fuel injector and a receiving borehole for the fuel injector, and the decoupling element being introduced between a valve housing of the fuel injector and a wall of the receiving borehole, the decoupling element comprising:

a decoupling system made of a contoured spring seat on a shoulder of the receiving borehole and a spring washer resting on the shoulder, wherein the spring seat has a tapered or conical end face on the upper side facing the spring washer.

8. A decoupling element for a fuel injection device for a fuel injection system of an internal combustion engine for direct injection of fuel into a combustion chamber, the fuel injection device having at least one fuel injector and a receiving borehole for the fuel injector, and the decoupling element being introduced between a valve housing of the fuel injector and a wall of the receiving borehole, the decoupling element comprising:

a decoupling system made of a contoured spring seat on a shoulder of the receiving borehole and a spring washer resting on the shoulder, wherein the spring seat has a pulvinate end face on an upper side facing the spring washer.

* * * * *